US009086646B2

(12) United States Patent
Fukusaka

(10) Patent No.: US 9,086,646 B2
(45) Date of Patent: Jul. 21, 2015

(54) IMAGE FORMING APPARATUS THAT CORRECTS DEVELOPING BIAS VOLTAGE

(71) Applicant: CANON KABUSHIKI KAISHA, Tokyo (JP)

(72) Inventor: Tetsuro Fukusaka, Abiko (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/246,397

(22) Filed: Apr. 7, 2014

(65) Prior Publication Data

US 2014/0301750 A1 Oct. 9, 2014

(30) Foreign Application Priority Data

Apr. 8, 2013 (JP) ..... 2013-080387

(51) Int. Cl.
*G03G 15/06* (2006.01)
*G03G 15/00* (2006.01)

(52) U.S. Cl.
CPC ..... *G03G 15/065* (2013.01); *G03G 15/505* (2013.01)

(58) Field of Classification Search
CPC ..... G03G 15/065; G03G 15/1675; G03G 2215/00632
USPC ..... 399/55, 240, 270, 285
See application file for complete search history.

(56) References Cited

U.S. PATENT DOCUMENTS

| | | | | |
|---|---|---|---|---|
| 5,235,515 | A | 8/1993 | Ungpiyakul et al. | |
| 2004/0057739 | A1 * | 3/2004 | Shimura | 399/49 |
| 2013/0002790 | A1 | 1/2013 | Chino et al. | |
| 2014/0301749 | A1 * | 10/2014 | Fukusaka et al. | 399/55 |

FOREIGN PATENT DOCUMENTS

| | | | |
|---|---|---|---|
| JP | 09-054487 | A | 2/1997 |
| JP | 2008-287075 | A | 11/2008 |

OTHER PUBLICATIONS

Machine translation of reference Ide (JP Pub No. 2008-287,075 A), Listed in IDS. Pub date Nov. 27, 2008.*

* cited by examiner

*Primary Examiner* — Rodney Bonnette
(74) *Attorney, Agent, or Firm* — Rossi, Kimms & McDowell LLP

(57) ABSTRACT

An image forming apparatus that reduces density irregularity caused by SD gap variation. A developing bias voltage for forming a developing electric field between a photosensitive drum and a developing sleeve is applied to the developing sleeve. Current values of an AC component of the developing bias voltage are detected while changing the acquisition timing for each rotation of the photosensitive drum, and detected current values are interpolated and averaged at each same phase with reference to the time of detection by the drum home position sensor HP. From the averaged current values of the variation curves of the developing bias AC current over the plurality of rotations, a correction table for an output control signal of the developing bias voltage is created. The developing bias voltage is controlled based on the created correction table.

3 Claims, 16 Drawing Sheets

WAVEFORM OF DEVELOPING BIAS VOLTAGE

IMAGE FORMING APPARATUS THAT CORRECTS DEVELOPING BIAS VOLTAGE

BACKGROUND OF THE INVENTION

1. Field of the Invention

The present invention relates to an image forming apparatus that corrects developing bias voltage.

2. Description of the Related Art

Conventionally, as a developing method for copy machines and printers using an electrophotographic technique, there has been employed a method in which a developing bias voltage formed by superimposing an AC voltage component, such as a sine wave voltage, a rectangular wave voltage, or a triangular wave voltage, on a DC voltage component is applied to a developing roller which is generally implemented as a developing sleeve containing a magnetic material (developing magnet). The DC voltage component mainly contributes to density of a developed image, and the AC voltage component mainly contributes to contrast of a developed image.

In this developing method, off-centering of a photosensitive drum, the developing roller (developing sleeve), and a spacer roller for holding a gap (SD gap) between the photosensitive drum and the developing roller sometimes causes periodic variation in the SD gap.

In this case, intensity of an electric field between the photosensitive drum and the developing roller periodically changes, which results in changes in density of a developed image.

As a solution to this problem, there has been disclosed a technique in which an AC component current of a developing bias is detected, and a DC component voltage of the same is sequentially changed according to the detected value of the AC component current, to thereby reduce density irregularity or variation caused by SD gap variation (see e.g. Japanese Patent Laid-Open Publication No. H09-54487).

Further, there has been disclosed a technique in which an image defect, such as density irregularity caused by SD gap variation, is reduced by performing FFT analysis of an AC current component of a detected developing bias to thereby extract a frequency component produced by off-centering of the photosensitive drum or the developing sleeve, calculating an opposite-phase component for offsetting the extracted frequency component, and superimposing an output of the opposite-phase component for offsetting the frequency component produced by off-centering, on the developing bias, at a timing shifted by a predetermined phase in synchronism with a drum rotation period during image formation (see e.g. Japanese Patent Laid-Open Publication No. 2008-287075).

However, in the image forming apparatus described in Japanese Patent Laid-Open Publication No. H09-54487, SD gap variation, as a cause of image density variation, is detected by the AC current component of the developing bias, and the DC voltage of the developing bias which changes image density is sequentially corrected, and hence image density variation can be corrected, but the AC current and the DC voltage of the developing bias have no direct correlation therebetween, and feedback control in this case does not form a feedback loop.

In other words, the feedback loop is not electrically closed, and hence if the amount of correction is increased, this increases a possibility of oscillation of the control, whereas if the amount of correction is reduced, this increases a possibility of an insufficient correction effect.

Further, although changes in the AC component current of the detected developing bias are sequentially corrected by correcting the DC voltage, the AC component current of the detected developing bias reflects not only variation caused by off-centering of the photosensitive drum or the developing sleeve but also variations caused by various factors. Therefore, this correction changes the DC voltage so as to correct even variations not required to be corrected, which can be a cause of unstable control.

Further, to perform FFT analysis of the AC current component of the detected developing bias to thereby extract the frequency component produced by off-centering of the photosensitive drum or the developing sleeve, as in the image forming apparatus disclosed in Japanese Patent Laid-Open Publication No. 2008-287075, a complicated FFT analysis circuit is required, which can be a factor increasing the costs.

SUMMARY OF THE INVENTION

The present invention provides an image forming apparatus that reduces density irregularity caused by SD gap variation.

The present invention provides an image forming apparatus comprising a photosensitive drum configured to be driven for rotation, a developing roller configured to carry toner for developing an electrostatic latent image formed on the photosensitive drum, the developing roller being disposed in a manner opposed to the photosensitive drum and driven for rotation, an application unit configured to apply a developing bias voltage for forming a developing electric field between the photosensitive drum and the developing roller, to the developing roller, formation of the developing electric field causing the electrostatic latent image to be developed with toner carried by the developing roller, a current value detection unit configured to detect a current value corresponding to an electrostatic capacitance between the photosensitive drum and the developing roller, a phase detection unit configured to detect a rotation phase of the photosensitive drum, a storage unit configured to perform operation for sampling a current value detected by the current value detection unit at a fixed time interval, in synchronism with a rotation phase detected by the phase detection unit, a plurality of times while changing detection start timing, and store a current value sampled each of the plurality of times, into a storage section, an interpolated current value calculation unit configured to interpolate current values sampled by the storage unit at each of the plurality of times of sampling to thereby calculate interpolated current values over one rotation of the photosensitive drum, for each time, an average value calculation unit configured to calculate an average value of ones at each same phase of the interpolated current values calculated by the interpolated current value calculation unit over one rotation of the photosensitive drum, for each time, a creation unit configured to create a correction table for correcting the developing bias voltage to be applied by the application unit, using the average value calculated by the average value calculation unit, and an image forming unit configured to control the developing bias voltage based on the correction table created by the creation unit.

According to the present invention, only change in rotation period of the photosensitive drum is extracted, and a correction value corresponding to an amount of the extracted change is fed back to the developing bias voltage. Therefore, it is possible to provide an image forming apparatus that reduces density irregularity caused by SD gap variation.

Further features of the present invention will become apparent from the following description of exemplary embodiments (with reference to the attached drawings).

BRIEF DESCRIPTION OF THE DRAWINGS

FIGS. 16A and 16B are diagrams formed by plotting values obtained by measuring brightness of an output image of an entire-surface halftone having 10% of density in a sub scanning direction in synchronism with an output from a drum home position sensor HP, in which FIG. 16A is a diagram before correction of density irregularity of the image, and FIG. 16B is a diagram after correction of density irregularity of the image.

DESCRIPTION OF THE EMBODIMENTS

The present invention will now be described in detail below with reference to the accompanying drawings showing embodiments thereof.

Figure 1:
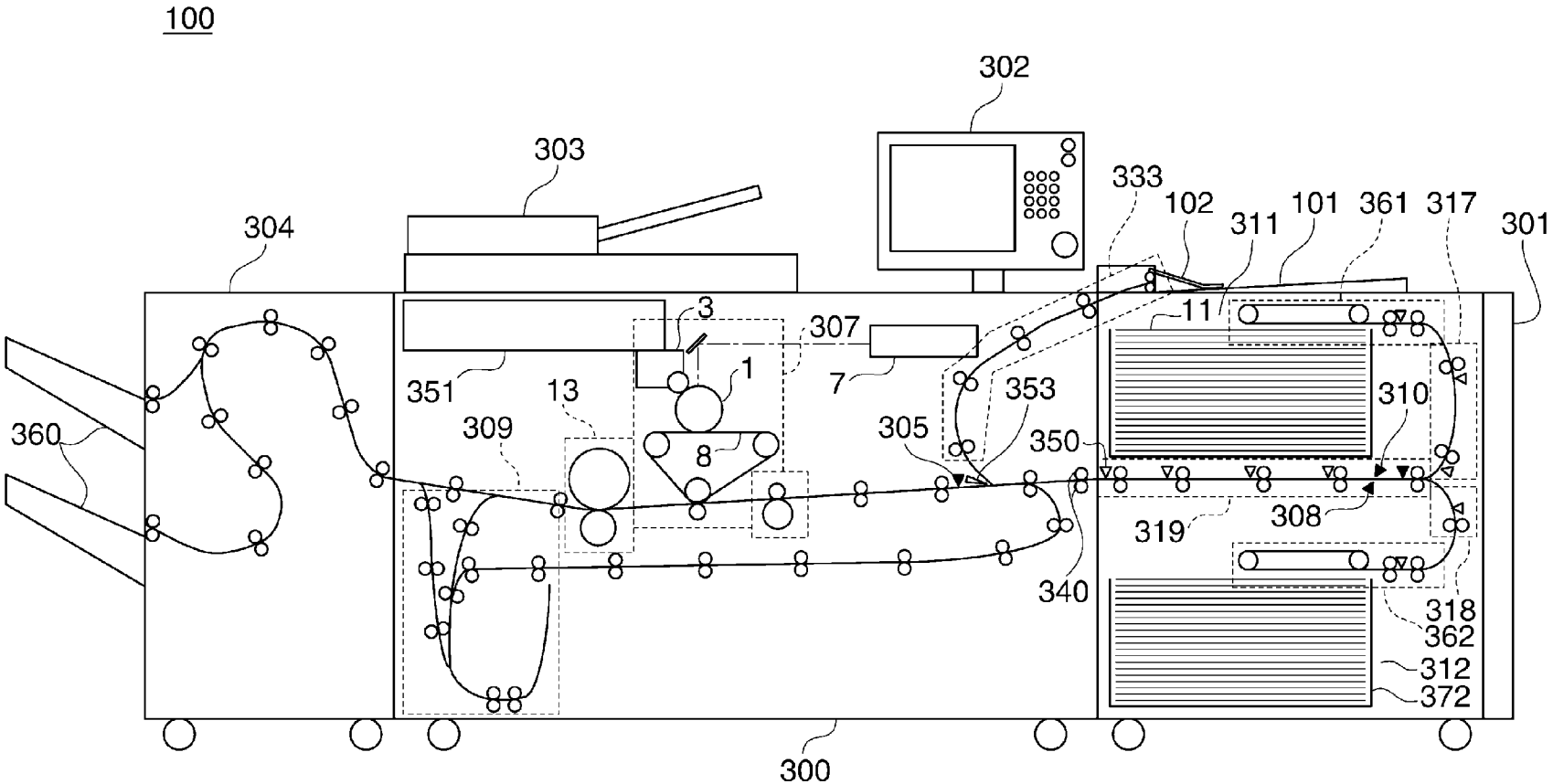
FIG. 1 is a schematic diagram of an image forming system including an image forming apparatus according to an embodiment of the present invention.

FIG. 1 is a schematic diagram of an image forming system 100 including an image forming apparatus 300 according to an embodiment of the present invention.

Referring to FIG. 1, the image forming system 100 comprises a sheet feeder 301, the image forming apparatus 300, a console section 302, a reader scanner 303, and a post-processing apparatus 304.

The image forming system 100 executes feeding and conveying of a sheet, image formation, and post processing, based on sheet processing settings set by a user from the console section 302 or from an external host PC, not shown, and image information sent from the reader scanner 303 or from the external host PC, and then outputs a print. A series of processing operations performed by the image forming apparatus will be described hereafter. Further, in the following description, "forming an image" is sometimes referred to simply as "printing".

The sheet feeder 301 comprises upper and lower sheet feeding sections 311 and 312 that store sheets stacked as sheet bundles in storages 11 and 372 provided therein, and feeds sheets from the sheet feeding sections 311 and 312, as needed.

The top of the sheet feeder 301 is provided with an escape tray 101 for discharging multi-fed sheets. A full stack detector 102 is provided for detecting a state of the escape tray 101 fully stacked with discharged sheets.

An operation for feeding a sheet is performed by sheet suction-conveyance sections 361 and 362. In the present embodiment, a plurality of fans, not shown, are arranged on the sheet suction-conveyance sections 361 and 362 for air feeding control.

In a sheet feeding operation, the fans are controlled such that air is blown in between sheets in each of the storages 11 and 372 from the upstream side in a conveying direction. When the sheets are separated, each sheet is fed and conveyed in a state sucked to an endless belt by a sheet suction fan arranged within the endless belt.

In the upper sheet feeding section 311, sheet conveyance is continued by an upper conveying section 317, whereas in the lower sheet feeding section 312, sheet conveyance is continued by a lower conveying section 318. In both of the cases, each sheet continues to be conveyed to a combined conveying section 319 where the upper conveying section 317 and the lower conveying sections 318 joins.

Although not shown, each conveying section includes a stepper motor for conveying a sheet. The stepper motor provided in each conveying section is controlled by a conveyance controller, and torque of the stepper motor is mechanically transmitted to rotate conveying rollers of each conveying section to thereby convey the sheet.

Further, the combined conveying section 319 is provided with a light emitting device 308 and a light receiving device 310 in a manner opposed to each other across a conveying path, which form a multi-feed detection sensor.

The sheet feeder 301 sequentially feeds and conveys sheets from each storage according to sheet request information received from the image forming apparatus 300. The sheet feeder 301 conveys each sheet to a conveyance sensor 350 disposed at a location where the sheet is passed to the image forming apparatus 300, and notifies the image forming apparatus of completion of preparation for passing the sheet from the sheet feeder 301 to the image forming apparatus 300.

Upon receipt of the notification of preparation completion from the sheet feeder 301, the image forming apparatus 300 sends a delivery request to the sheet feeder 301. The sheet feeder 301 sequentially conveys the sheets one by one to the image forming apparatus in response to each delivery request.

When a leading edge of a sheet conveyed out of the sheet feeder 301 reaches a nip of a conveying roller pair 340 as the most upstream pair of the image forming apparatus 300, the sheet is drawn out of the sheet feeder 301 into the image forming apparatus 300 by the conveying roller pair 340.

The sheet feeder 301 terminates the feeding operation when conveyance of the number of sheets requested by the image forming apparatus 300 is completed. Then, the sheet feeder 301 terminates its operation after the sheets have been drawn out by the image forming apparatus 300, and then enters the standby state.

The image forming apparatus 300 sends the delivery request to the above-described sheet feeder 301, and draws the sheets out of the sheet feeder 301 one by one to sequentially perform image formation thereon.

The console section 302 for allowing a user to configure operation settings of the image forming apparatus and the reader scanner 303 for reading an original image are arranged on the top of the image forming apparatus 300.

After receiving each sheet from the sheet feeder 301 connected to the image forming apparatus 300, the image forming apparatus 300 causes conveying sections to convey the sheet. A flapper 353 selects a conveying path leading to the escape tray 101 when multi-feed of sheets is detected by the light emitting device 308 and the light receiving device 310, and a conveying path leading to an image forming section 307 when multi-feed of sheets is not detected.

If multi-feed of sheets is detected, the sheets are discharged to the escape tray 101. If multi-feed of sheets is not detected, an image forming operation based on received image data is performed by the image forming section 307 with reference to a time point that the sheet is detected by an image reference sensor 305.

Although in the present embodiment, the image forming apparatus 300 is provided with an escape conveying section 333 for discharging a sheet to the escape tray 101, the escape conveying section 333 may be provided in the sheet feeder 301.

Then, a semiconductor laser of a laser scanner 7 is lighted on, light amount control is performed, and a scanner motor which drives a polygon mirror, not shown, for rotation is controlled to thereby form a latent image on a photosensitive drum 1 as a photosensitive member of the present invention, with a laser beam based on the image data.

A developing device 3 to which toner is supplied from a toner bottle 351 develops the latent image on the photosensitive drum 1 with toner, and the developed toner image is primarily transferred to an intermediate transfer belt 8 from the photosensitive drum 1.

The toner image transferred to the intermediate transfer belt 8 is secondarily transferred to a sheet, whereby the toner image is formed on the sheet. The sheet which has been subjected to secondary transfer is conveyed to a fixing section 13, and the fixing section 13 applies heat and pressure to the sheet to thereby fuse and fix the toner on the sheet.

The sheet having the toner fixed thereon is conveyed to an inversion conveying section 309 when it is necessary to invert the sheet, such as when the sheet is to be sequentially printed on a reverse side thereof, whereas if printing on the sheet is completed, conveyance of the sheet is continued to thereby convey the sheet to a discharge device disposed at a location downstream of the fixing section 13.

The post-processing apparatus 304 connected to the downstream side of the image forming apparatus 300 executes desired post processing, such as folding, stapling, and punching, set by the user from the console section 302, on sheets on which image formation has been performed, and sequentially outputs printed matter thus formed onto a discharge tray 360.

Figure 2:
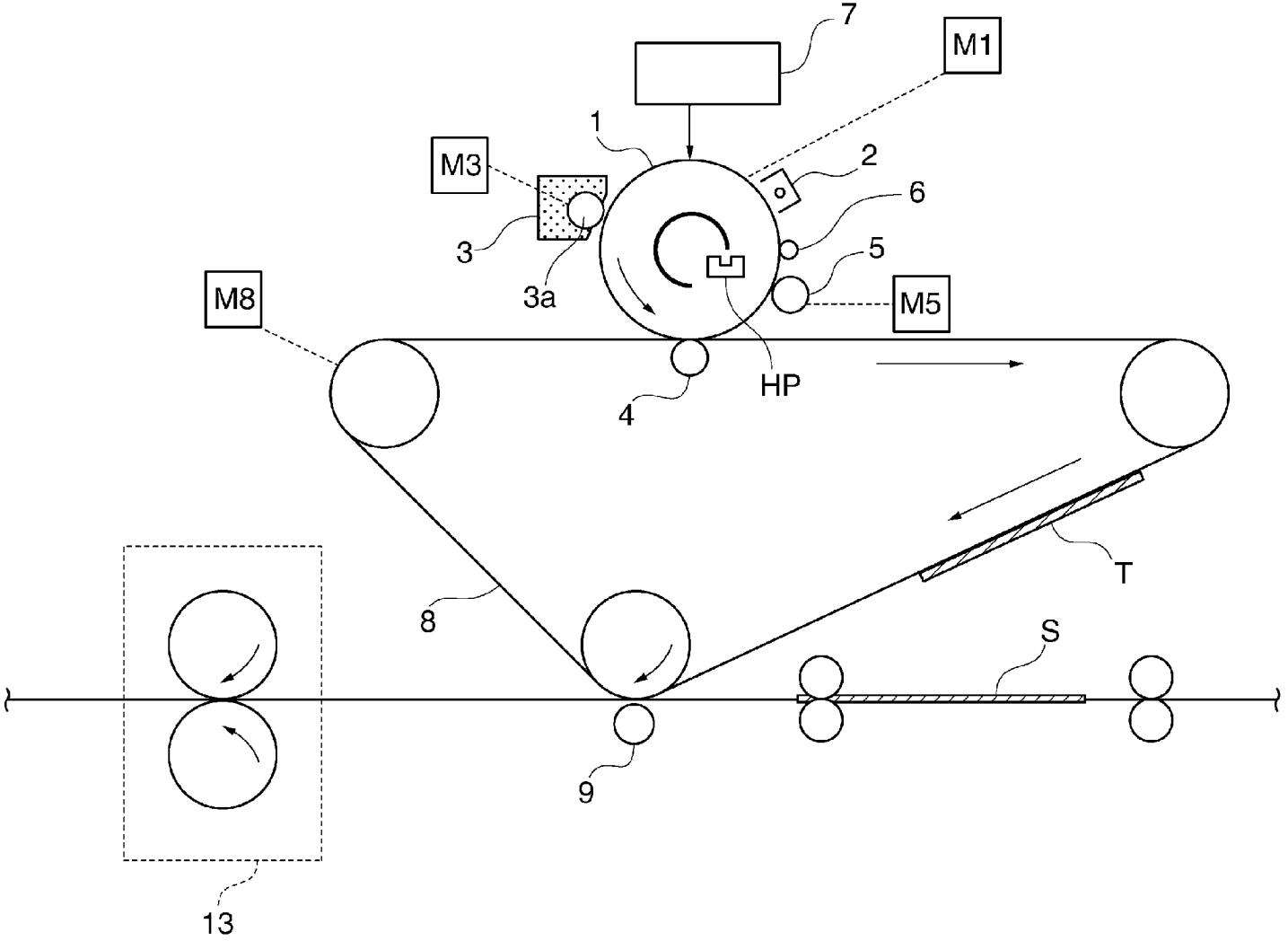
FIG. 2 is a schematic diagram of an image forming section appearing in FIG. 1.

FIG. 2 is a schematic diagram of the image forming section 307 appearing in FIG. 1.

Referring to FIG. 2, the image forming apparatus 300 has a structure in which a primary electrostatic charger 2, the developing device 3, a primary transfer roller 4, a cleaner 5, and a pre-exposure section 6 are arranged around the photosensitive drum 1.

The developing device 3 includes a developing sleeve 3*a*, as a developing roller of the present invention, which is disposed in a manner opposed to the photosensitive drum 1, and carries developer (toner, or toner and magnetic carrier) for developing an electrostatic latent image carried on the photosensitive drum 1. The rotational axis of the photosensitive drum 1 and the rotational axis of the developing sleeve 3*a* are fixed by a casing of the apparatus and a spacer, whereby a predetermined distance is secured therebetween.

The electrostatic latent image formed on the rotating photosensitive drum 1 by the laser scanner 7 is developed by the developing device 3 into a toner image. The photosensitive drum 1 is driven for rotation by a drum motor M1, and a drum home position sensor HP detects rotation of the photosensitive drum 1.

The drum home position sensor HP corresponds to a phase detection unit configured to detect a rotation phase of the photosensitive drum 1, and generates a detection signal whenever the photosensitive drum 1 performs one rotation to thereby enable detection of a rotation phase of the photosensitive drum 1. Note that the drum home position refers to a home position of the photosensitive drum 1.

The developing sleeve 3*a* of the developing device 3 is driven for rotation by a developing sleeve motor M3. The developed toner image is transferred onto the intermediate transfer belt 8 by the primary transfer roller 4, and is sent to a secondary transfer section 9.

The intermediate transfer belt 8 is driven by an ITB (intermediate transfer belt) motor M8. The secondary transfer section 9 transfers the toner image T on the intermediate transfer belt 8 onto a conveyed sheet S. A cleaner motor M5 drives the cleaner 5.

Figure 3:
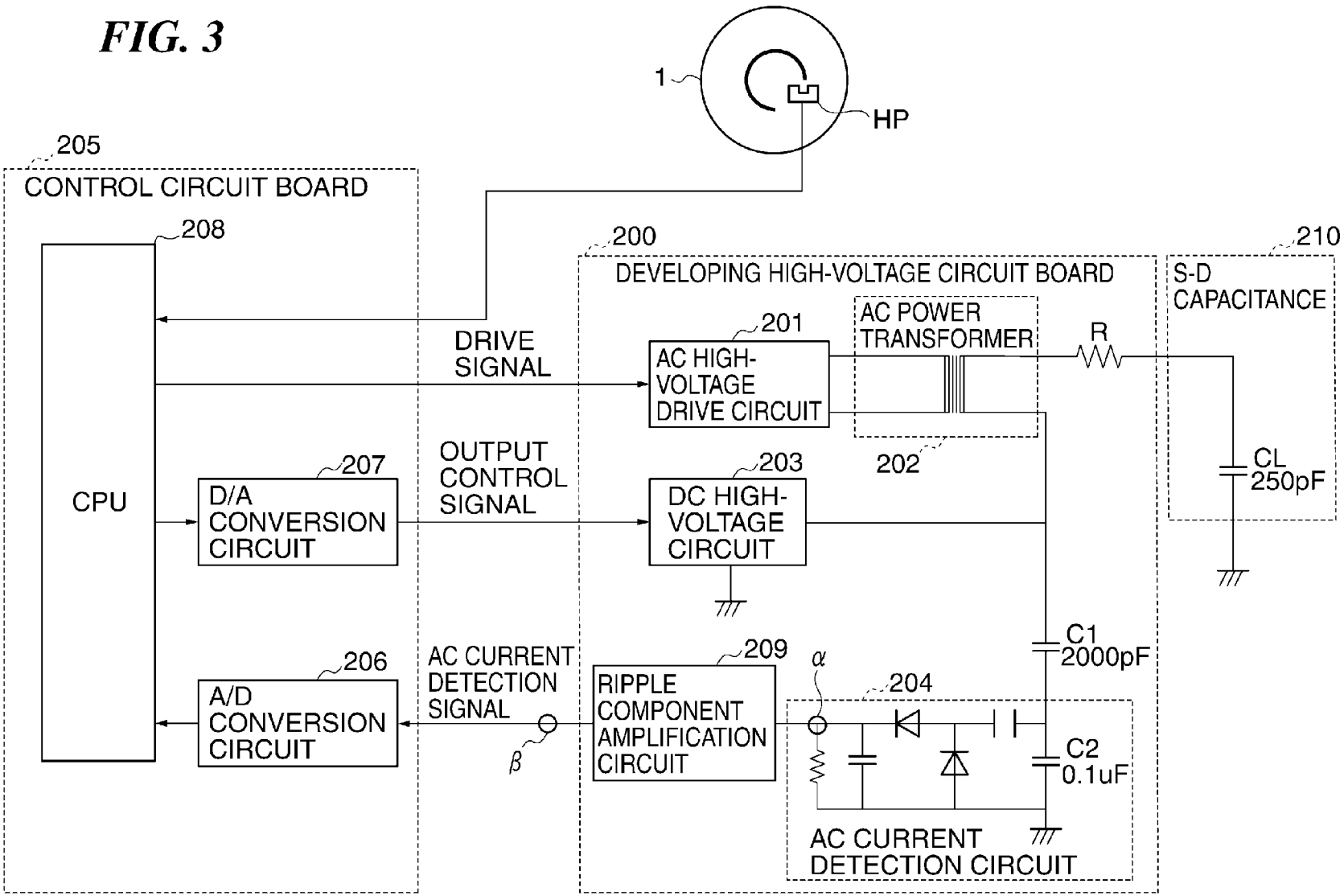
FIG. 3 is a schematic diagram of a developing high-voltage circuit board and a control circuit board of the image forming apparatus appearing in FIG. 1.

FIG. 3 is a schematic diagram of a developing high-voltage circuit board 200 and a control circuit board 205 of the image forming apparatus 300 appearing in FIG. 1.

Referring to FIG. 3, the image forming apparatus 300 is equipped with the developing high-voltage circuit board 200 and the control circuit board 205.

Mounted on the developing high-voltage circuit board 200 are an AC high-voltage drive circuit 201, an AC power transformer 202, a DC high-voltage circuit 203, an AC current detection circuit 204, a ripple component amplification circuit 209, a capacitor C1, a capacitor C2, and an output register R.

The AC high-voltage drive circuit 201, the DC high-voltage circuit 203, and the AC transformer correspond to an application unit configured to apply a developing bias voltage to the developing sleeve 3*a*, so as to form a developing electric field between the photosensitive drum 1 and the developing sleeve 3*a*.

Mounted on the control circuit board 205 are an analog-to-digital converter circuit 206, a digital-to-analog converter circuit 207, and a CPU 208.

On the developing high-voltage circuit board 200, the AC high-voltage drive circuit 201 generates a developing AC bias voltage, and the AC transformer 202 superimposes a developing DC bias voltage generated by the DC high-voltage circuit 203 on the generated developing AC bias voltage, whereby the resulting developing bias voltage is supplied to the developing sleeve 3*a*. That is, the developing bias voltage formed by superimposing the developing AC bias voltage and the developing DC bias voltage is applied to an S-D capacitance 210 appearing in FIG. 3. Note that α and β in FIG. 3 will be referred to hereinafter.

Figure 4:
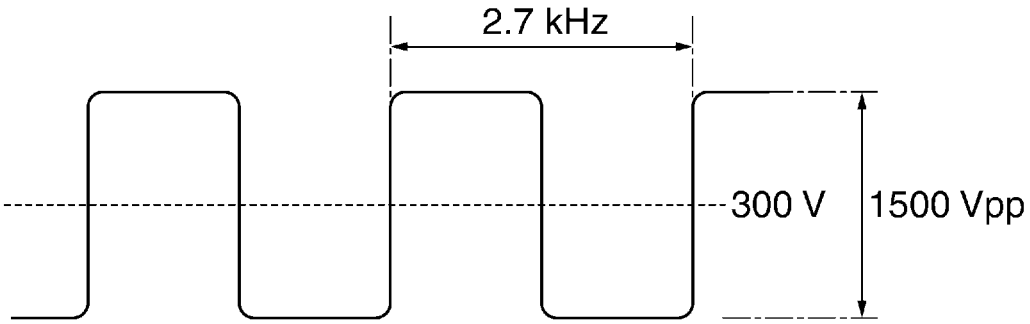
FIG. 4 is a diagram showing a waveform of a developing bias voltage formed by superimposing a developing AC bias voltage and a developing DC bias voltage.

FIG. 4 is a diagram showing a waveform of the developing bias voltage formed by superimposing the developing AC bias voltage and the developing DC bias voltage.

As shown in FIG. 4, in the image forming apparatus 300 according to the present embodiment, the developing bias voltage is formed by superimposing the developing DC bias voltage (Vdc) of 300V on the developing AC bias voltage having a rectangular wave of a frequency of 2.7 kHz and an amplitude of 1500V. The developing bias voltage thus formed by superimposing the AC voltage and the DC voltage is applied.

An SD gap formed by the developing sleeve 3*a* and the photosensitive drum 1 as an electric equivalent circuit provides an electrostatic capacitance, and is represented by an S-D capacitance CL in FIG. 3. In the image forming apparatus 300 according to the present embodiment, the S-D capacitance CL is approximately 250 pF.

Referring again to FIG. 3, an AC current component of the developing bias supplied from the AC power transformer 202 to the photosensitive drum 1 via the developing sleeve 3*a* is detected by the AC current detection circuit 204. The AC current detection circuit 204 thus detects a current value of an AC component caused to flow by the developing bias voltage applied by the AC high-voltage drive circuit 201 and the DC high-voltage circuit 203. The AC current detection circuit 204 corresponds to a current value detection unit configured to detect a current value which is proportional to the electrostatic capacitance between the photosensitive drum 1 and the developing sleeve 3*a*.

Figure 5:
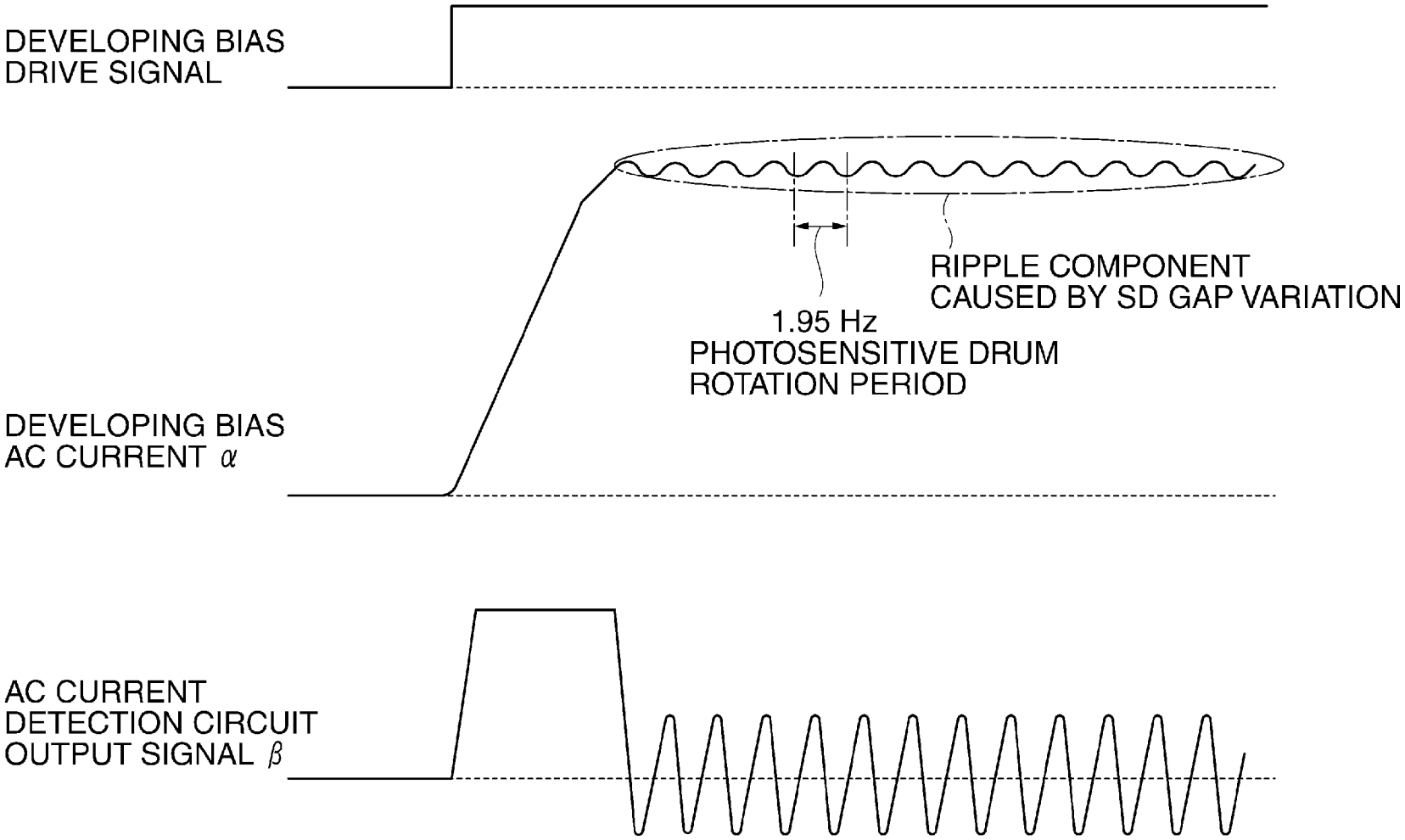
FIG. 5 is a timing diagram of a developing bias drive signal, a developing bias AC current, and a signal output from an AC current detection circuit, at the time of application of a developing bias to a developing sleeve appearing in FIG. 2.

FIG. 5 is a timing diagram of a developing bias drive signal, a developing bias AC current, and a signal output from the AC current detection circuit 204, at the time of application of the developing bias to the developing sleeve 3*a* appearing in FIG. 2.

When the developing bias drive signal is turned on, the developing bias is applied to the developing sleeve 3*a*, whereby the AC current is supplied to the S-D capacitance CL. This current is output from the AC current detection circuit 204 (a point in FIG. 3), and then is output from the ripple component amplification circuit 209 after only a ripple component of the AC current is amplified by the ripple component amplification circuit 209 (β point in FIG. 3). Further, as shown in FIG. 5, a period of the ripple component is 1.95 Hz which is the rotation period of the photosensitive drum 1.

The ripple component amplification circuit 209 clamps a voltage not lower than or not higher than a predetermined voltage according to a range of allowable input voltage of the analog-to-digital converter circuit 206, and outputs the clamped voltage to the analog-to-digital converter circuit 206.

When the SD gap changes, the electrostatic capacitance CL formed by the SD gap changes, and hence the change can be detected as a change in developing bias AC current.

Figure 6:
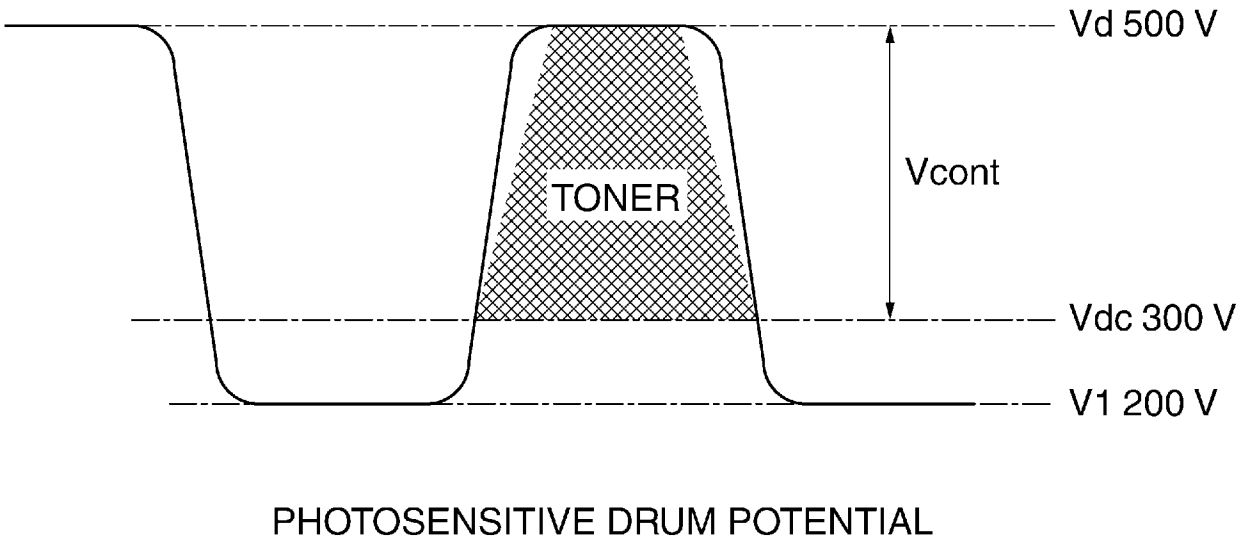
FIG. 6 is a diagram showing a relationship between a potential of a photosensitive drum appearing in FIG. 2 and the developing DC bias voltage.

FIG. 6 is a diagram showing a relationship between a potential of the photosensitive drum 1 appearing in FIG. 2 and the developing DC bias voltage Vdc.

In the image forming apparatus 300 according to the present embodiment, toner is negatively charged, and hence more amount of toner is developed as the potential of the photosensitive drum 1 is higher. In FIG. 6, Vd represents a charging potential (dark part potential) of the photosensitive drum 1, Vdc the developing DC bias voltage, and V1 a potential of an exposed part (bright part potential). As the difference, denoted by Vcont, between Vd and Vdc is larger, developability becomes higher.

On the other hand, if the SD gap is increased, developability becomes lower. At this time, the S-D electrostatic capacitance CL is reduced, so that the detected developing bias AC current is reduced. Therefore, by reducing Vdc to thereby secure Vcont, developability can be increased.

Inversely, if the SD gap is reduced, developability becomes higher. At this time, the S-D electrostatic capacitance CL is increased, so that the developing bias AC current is increased. Therefore, by increasing Vdc to thereby reduce Vcont, developability can be reduced.

In the control circuit board 205, the analog-to-digital converter circuit 206 converts an AC current detection signal output from the AC current detection circuit 204 from analog to digital, and transfers the converted signal to the CPU 208.

Figure 7A:
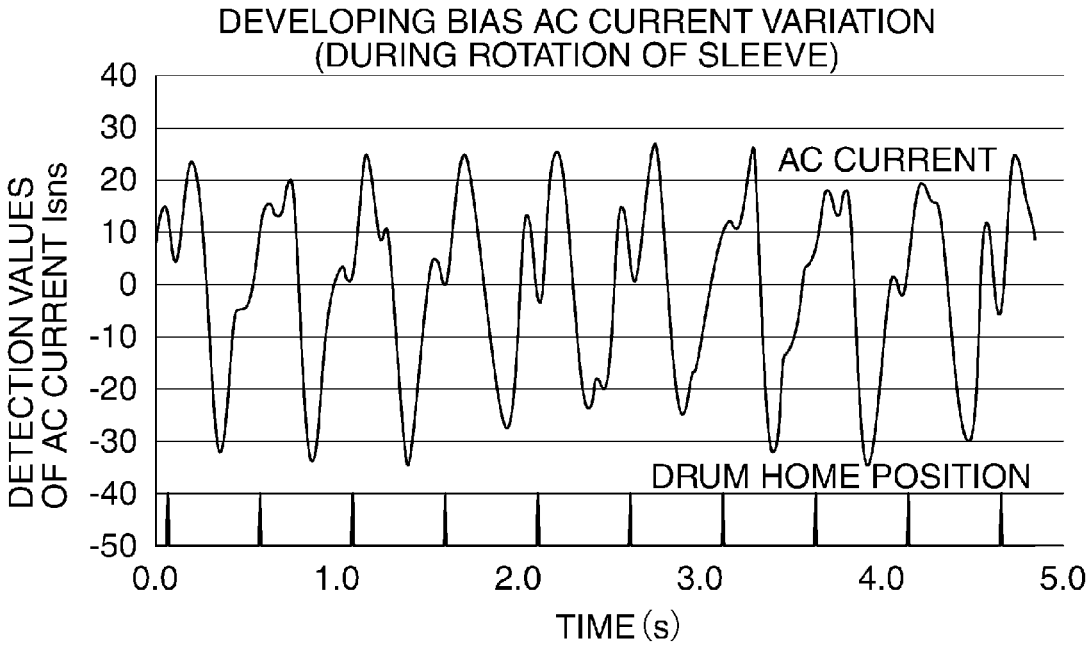
FIG. 7A is a diagram showing a waveform of variation in the developing bias AC current.
Figure 7B:
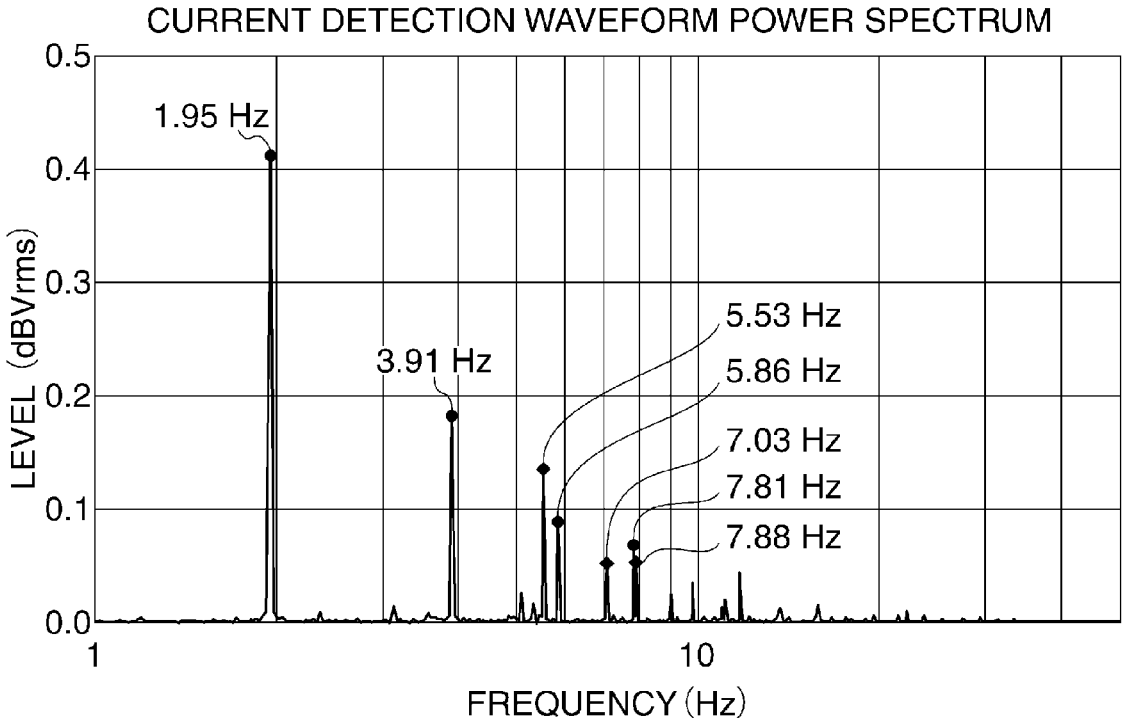
FIG. 7B is a diagram showing a result of FFT analysis of the waveform of variation in the developing bias AC current.

FIGS. 7A and 7B are diagrams showing a waveform of variation in the developing bias AC current and results of FFT (fast Fourier transform) analysis of the developing bias AC current.

FIG. 7A is a diagram showing a waveform of the developing bias AC current and the drum home position signal, in a case where all of the drive sections of the image forming system, such as the photosensitive drum 1, the developing sleeve 3*a*, and the intermediate transfer belt 8, are being rotated e.g. during normal printing.

In a graph shown in FIG. 7A, the horizontal axis represents time, and the vertical axis represents detection values of the developing bias AC current. FIG. 7A shows that the developing bias AC current varies at a rotation period of the photosensitive drum 1.

FIG. 7B is a diagram showing results of FFT analysis of the waveform of the developing bias AC current.

The frequency corresponding to the rotation period of the photosensitive drum 1 of the image forming apparatus 300 according to the present embodiment is 1.95 Hz, and with this as a base frequency, the graph indicates that frequencies of 3.91 Hz, 5.86 Hz, and 7.81 Hz, which are twice, three times, and four times the base frequency, are strongly detected.

A frequency 5.53 Hz, which is another detected frequency than the above-mentioned frequencies corresponding to the drum rotation period and integral multiples thereof, corresponds to a rotation period of the developing sleeve 3*a*, and frequencies 7.03 Hz and 7.88 Hz are those corresponding to rotation periods of components of a drive system, not shown, of the developing sleeve 3*a*. It is confirmed that the levels of these frequencies are not larger than ⅓ of those of the frequencies indicative of variation in the developing bias AC current caused by the rotation period of the photosensitive drum 1.

Figure 8A:
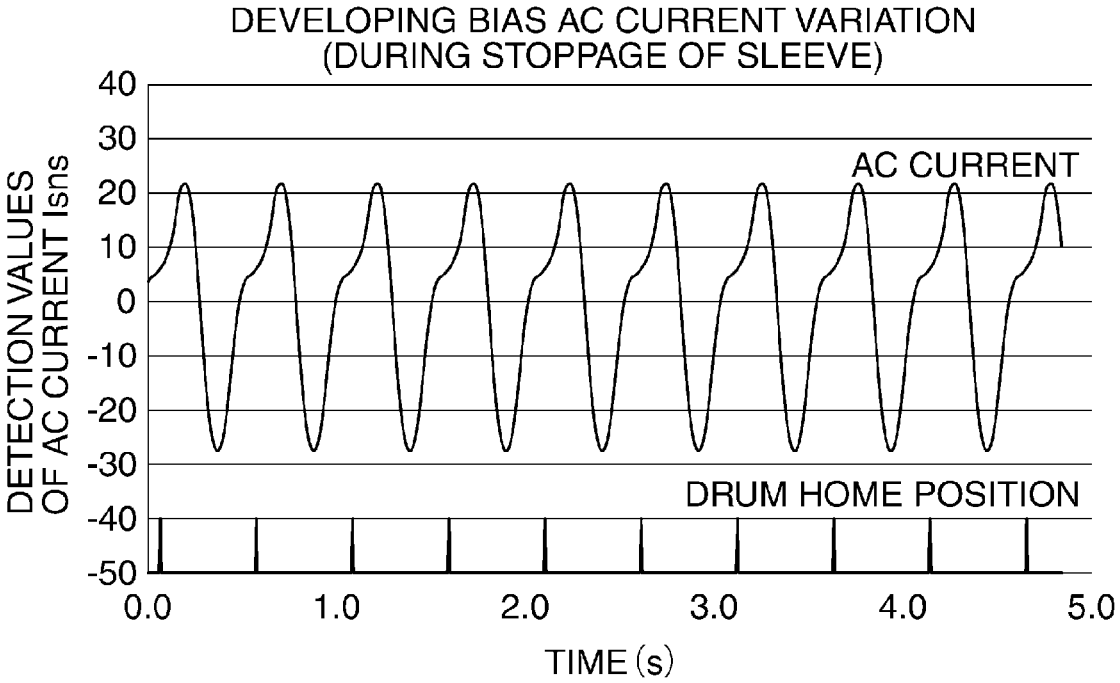
FIG. 8A is a diagram showing a waveform of an AC current and a drum home position signal in a rotation-stopped state of the developing sleeve that rotates during normal printing.

FIG. 8A is a diagram showing a waveform of the developing bias AC current and the drum home position signal in a rotation-stopped state of the developing sleeve 3*a* that rotates during normal printing.

There is no frequency components caused by the rotation periods of the developing sleeve 3*a* and the components of the drive system of the developing sleeve 3*a*, and hence most of changes are caused by the rotation period of the photosensitive drum 1, whereby the same waveform is repeated at the rotation period of the photosensitive drum 1.

Here, it is understood that most of changes in the developing bias AC current are caused by the rotation period of the photosensitive drum 1. Changes caused by the developing sleeve 3*a* are excluded, and hence an amplitude of changes is reduced by approximately 10 to 20%, compared with that shown FIG. 7A.

Figure 8B:
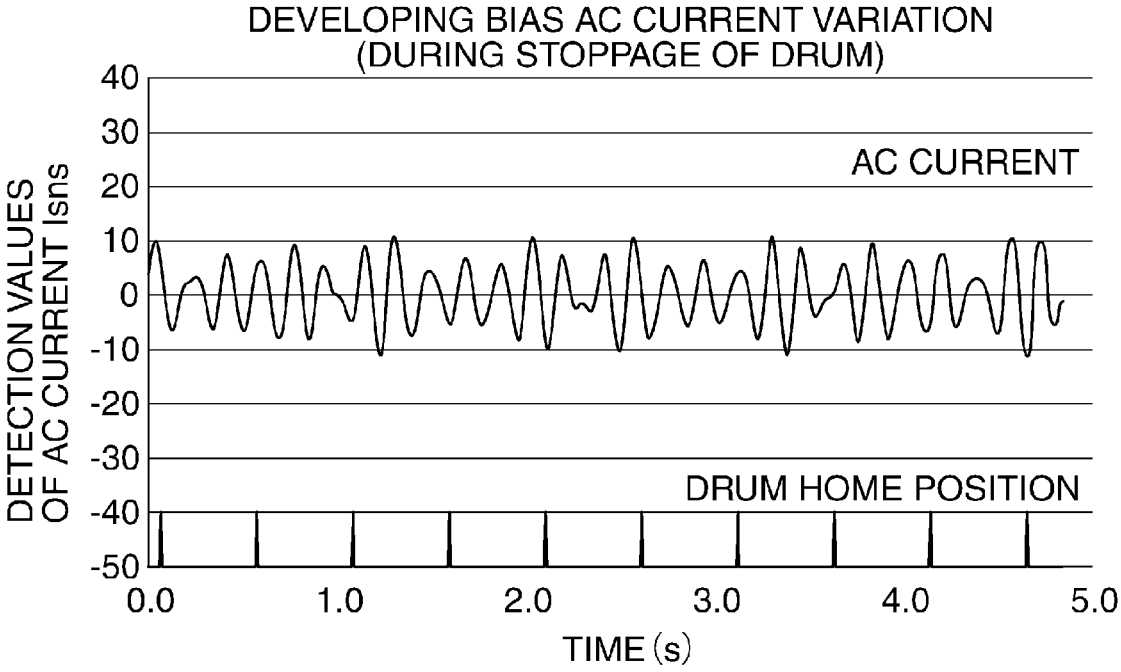
FIG. 8B is a diagram showing a waveform of the AC current and the drum home position signal in the rotation-stopped state of the photosensitive drum.

FIG. 8B is a diagram showing a waveform of the developing bias AC current and the drum home position signal in the rotation-stopped state of the photosensitive drum 1.

As is also understood from the power spectrum shown in FIG. 7B, in FIG. 8B, since most of changes in the developing bias AC current are caused by the photosensitive drum, the amplitude of changes is within approximately ¼ of that in the normal state. Further, as a matter of course, the changes are not related to the rotation period of the photosensitive drum 1, and it is understood that these frequency components cannot be corrected by controlling the rotation period of the photosensitive drum 1.

Figure 9A:
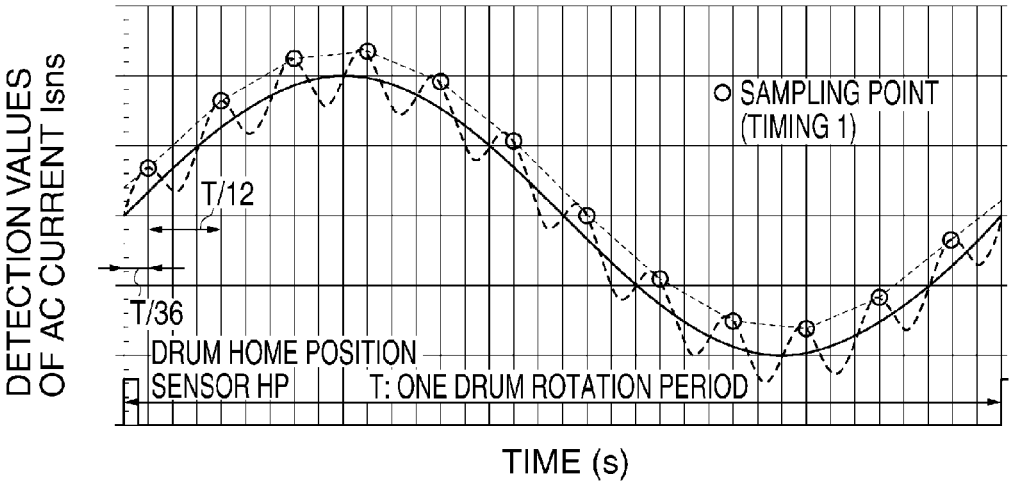
FIGS. 9A to 9C are diagrams useful for explaining a phase relationship between AC current waveform of developing bias detected by AC current detection circuit in FIG. 3 and home position of the photosensitive drum, and timing of detection of the developing bias AC current.
Figure 9B:
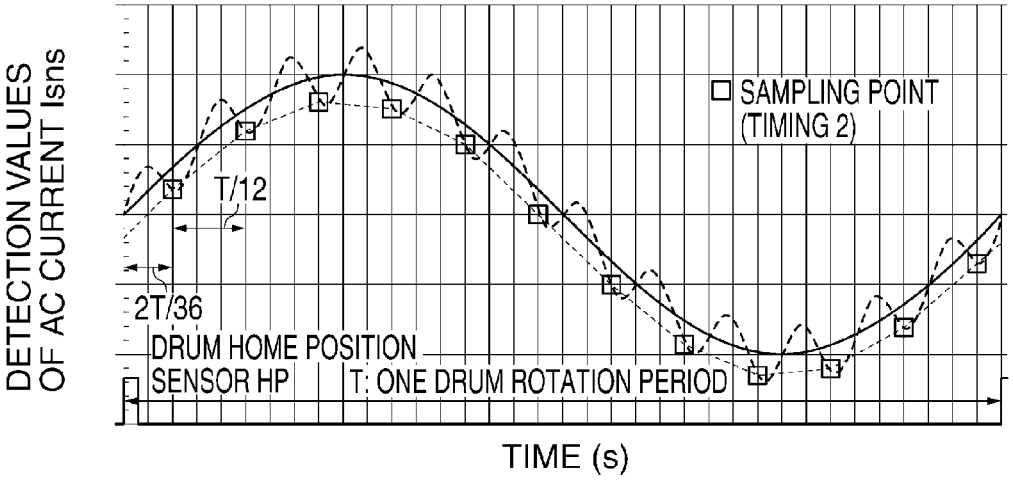
Figure 9C:
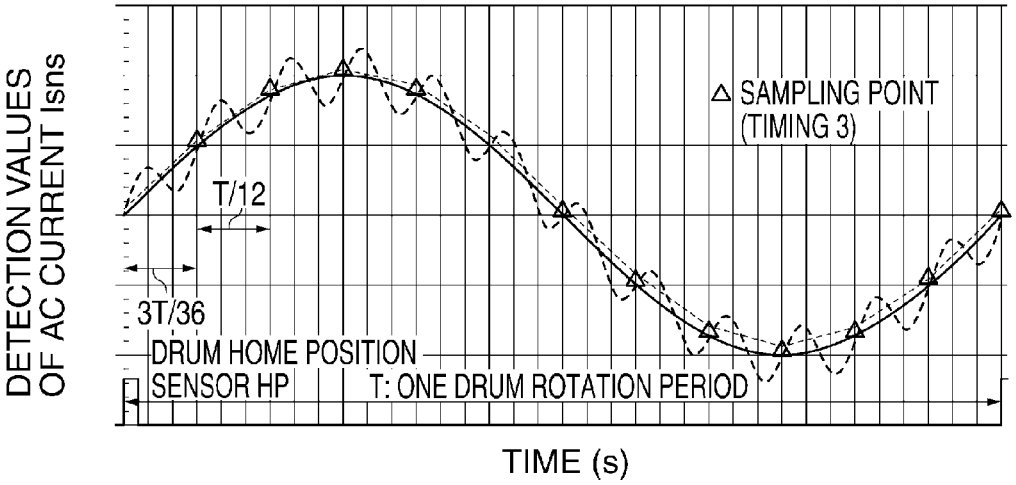

FIGS. 9A to 9C are diagrams useful for explaining a phase relationship between AC current waveform of developing bias detected by the AC current detection circuit 204 in FIG. 3 and home position of the photosensitive drum 1, and timing of detection of the developing bias AC current. In each of FIGS. 9A to 9C, the horizontal axis represents time, and the vertical axis represents detection values of the developing bias AC current.

In each of FIGS. 9A to 9C, a waveform indicated by a solid line represents variation in the developing bias AC current actually occurring at a rotation period T of the photosensitive drum 1, whereas a waveform indicated by a broken line represents variation in the developing bias AC current formed by superimposing variation at a frequency which is 12 times as high as the frequency corresponding to the rotation period T of the photosensitive drum 1, on the waveform indicated by the solid line.

FIG. 9A is a diagram showing variation in the developing bias AC current formed by connecting values of sampling data acquired at sampling points occurring at a repetition period of T/12 after the lapse of a period of T/36 from detection of the home position of the photosensitive drum 1.

In FIG. 9A, each value of sampling data is indicated by a circle, and the variation in the developing bias AC current on which the variation at the frequency which is 12 times as high as the frequency corresponding to the rotation period T of the photosensitive drum 1 is superimposed is in a state offset upward with respect to the variation in the developing bias AC actually caused by variation in the rotation period of the photosensitive drum 1.

FIG. 9B is a diagram showing variation in the developing bias AC current formed by connecting values of sampling data acquired at sampling points occurring at the repetition period of T/12, after the lapse of a period of 2T/36 from detection of the home position of the photosensitive drum 1.

In FIG. 9B, each value of sampling data is indicated by a square, and the variation in the developing bias AC current on which the variation at the frequency which is 12 times as high as the frequency corresponding to the rotation period T of the photosensitive drum 1 is superimposed is in a state offset downward with respect to the variation in the developing bias AC actually caused by variation in the rotation period of the photosensitive drum 1.

FIG. 9C is a diagram showing variation in the developing bias AC current formed by connecting values of sampling data acquired at sampling points occurring at the repetition period of T/12, after the lapse of a period of 3T/36 from detection of the home position of the photosensitive drum 1.

In FIG. 9C, each value of sampling data is indicated by a triangle, and the variation in the developing bias AC current on which the variation at the frequency which is 12 times as high as the frequency corresponding to the rotation period T of the photosensitive drum 1 is superimposed is in a state showing very little difference from the variation in the developing bias AC actually caused by variation in the rotation period of the photosensitive drum 1.

That is, in the case where frequency variation is superimposed which is integral multiple times higher in frequency than the frequency variation corresponding to the rotation period of the photosensitive drum 1, even if sampling is executed over a plurality of times of rotation, peaks of the frequency variation multiple times higher in frequency may always appear at the same positions in the rotation period of the photosensitive drum 1. From this, it is understood that it is impossible to eliminate such noises of frequency variation.

To overcome the problem, in the present embodiment, first, sampling of the developing bias AC current is executed over a plurality of rotations of the photosensitive drum 1 while changing detection timing from one rotation to another to thereby change sampling points during each rotation of the photosensitive drum 1. Thus, in the present embodiment, the operation of sampling a current value detected by the AC current detection circuit 204 at a fixed time interval is executed a plurality of times while changing the timing of the start of the detection.

Figure 10A:
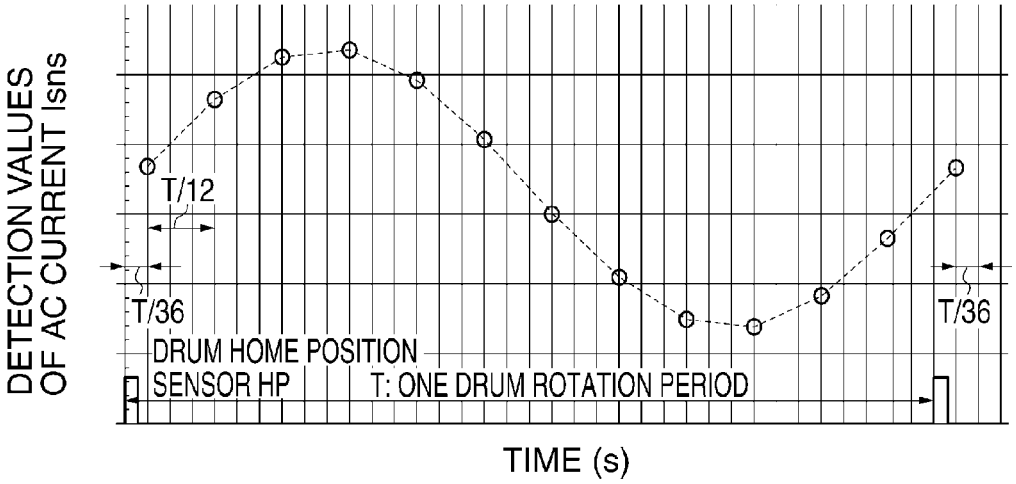
FIGS. 10A to 10C are diagrams showing variation curves of the developing bias formed by connecting values at sampling points of three kinds of sampling data shown in FIGS. 9A to 9C, respectively.
Figure 10B:
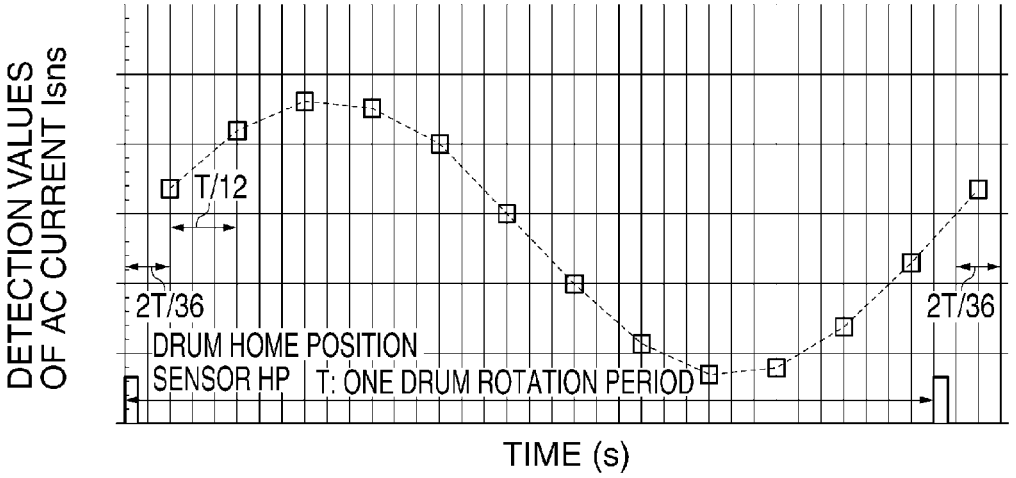
Figure 10C:
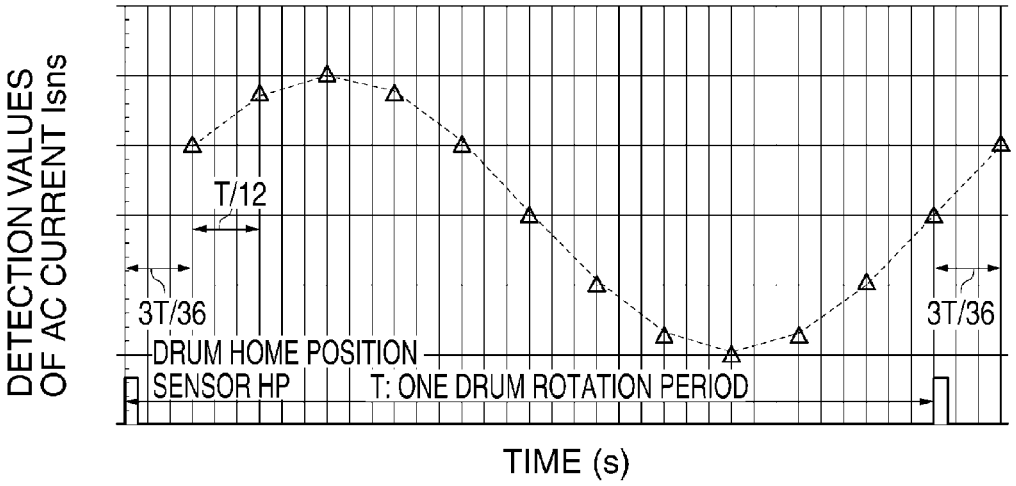

FIGS. 10A to 10C are diagrams showing variation curves of the developing bias AC current formed by connecting values at sampling points of three kinds of sampling data shown in FIGS. 9A to 9C, respectively.

FIG. 10A is a diagram showing variation in the developing bias AC current formed by connecting values of sampling data acquired at sampling points occurring at the repetition period of T/12, after the lapse of the period of T/36 from detection of the home position of the photosensitive drum 1.

FIG. 10B is a diagram showing variation in the developing bias AC current formed by connecting values of sampling data acquired at sampling points occurring at the repetition period of T/12, after the lapse of the period of 2T/36 from detection of the home position of the photosensitive drum 1.

FIG. 10C is a diagram showing variation in the developing bias AC current formed by connecting values of sampling data acquired at sampling points occurring at the repetition period of T/12, after the lapse of the period of 3T/36 from detection of the home position of the photosensitive drum 1.

Sampling of the AC current is performed over time corresponding to the one rotation period of the photosensitive drum 1. Then, a variation curve is calculated by connecting values of sampling data acquired for each one rotation, and each variation curve is made synchronous with the home position reference of the photosensitive drum 1.

Figure 11A:
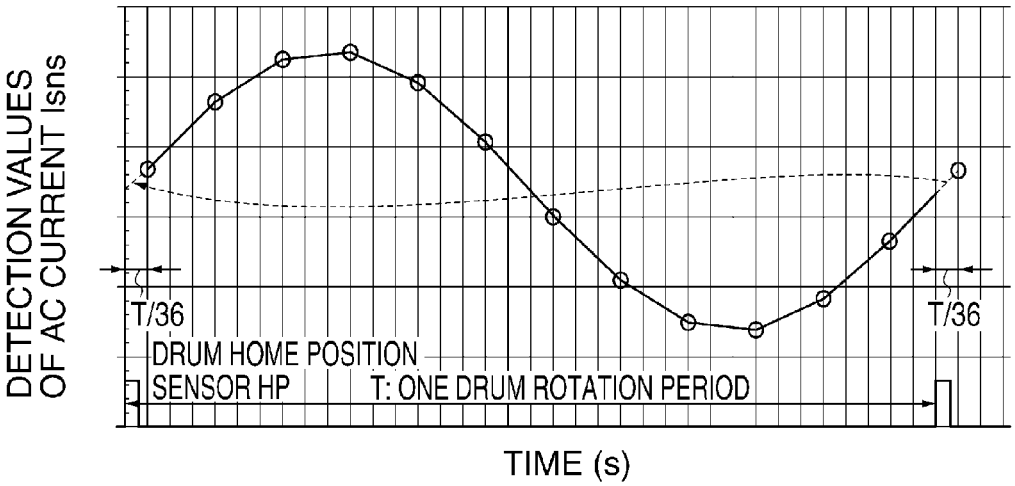
FIGS. 11A to 11C are diagrams showing variation curves of the developing bias AC current made synchronous with a home position reference.
Figure 11B:
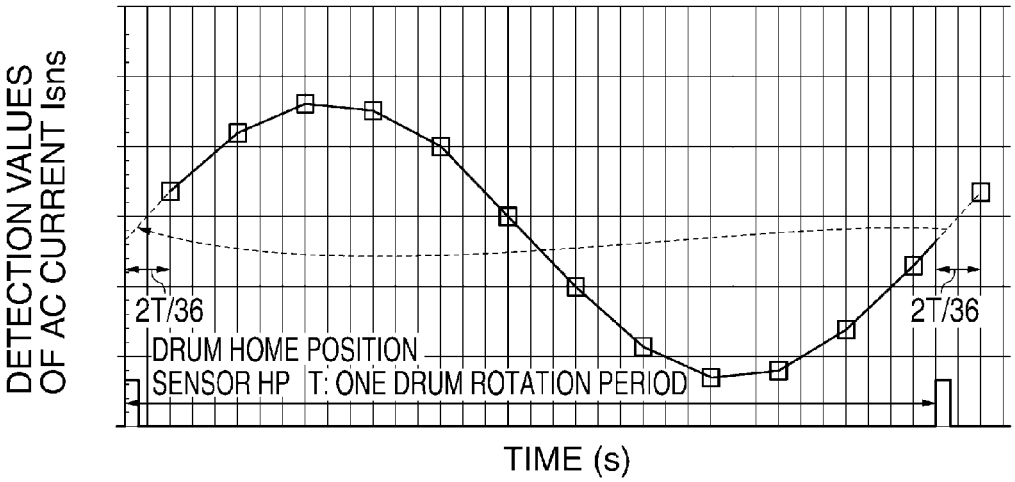
Figure 11C:
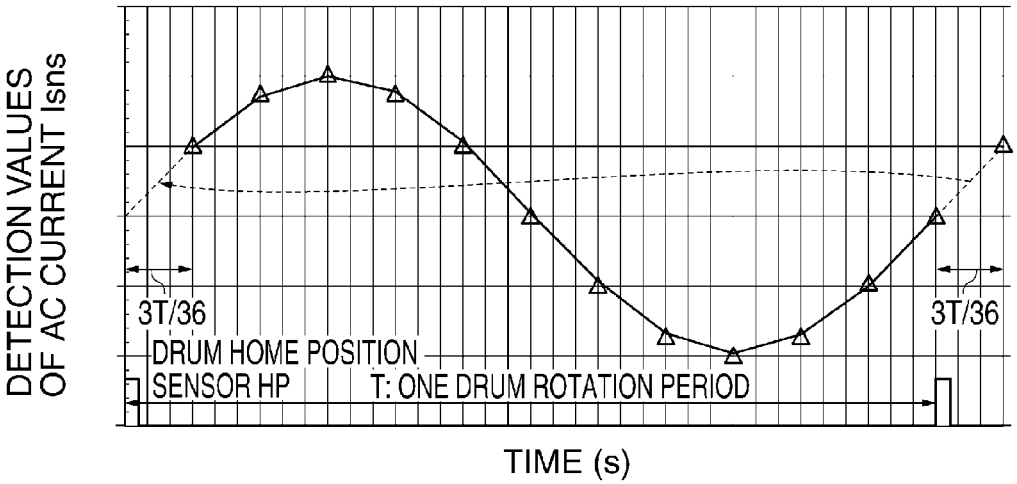

FIGS. 11A to 11C are diagrams showing variation curves of the developing bias AC current made synchronous with the home position reference.

FIG. 11A shows the variation curve of AC current detection values in which the FIG. 10A variation curve formed by connecting AC current detection values is made synchronous with the home position reference of the photosensitive drum 1 by using, as values during a delay (T/36) from detection of the home position of the photosensitive drum 1 to the start of sampling, values during a delay (T/36) from next detection of the home position of the photosensitive drum 1 to the start of sampling.

FIG. 11B shows the variation curve of AC current detection values in which the FIG. 10B variation curve formed by connecting AC current detection values is made synchronous with the home position reference of the photosensitive drum 1 by using, as values during a delay (2T/36) from detection of the home position of the photosensitive drum 1 to the start of sampling, values during a delay (2T/36) from next detection of the home position of the photosensitive drum 1 to the start of sampling.

FIG. 11C shows the variation curve of AC current detection values in which the FIG. 10B variation curve formed by connecting AC current detection values is made synchronous with the home position reference of the photosensitive drum 1 by using, as values during a delay (3T/36) from detection of the home position of the photosensitive drum 1 to the start of sampling, values during a delay (2T/36) from next detection of the home position of the photosensitive drum 1 to the start of sampling.

Figure 12:
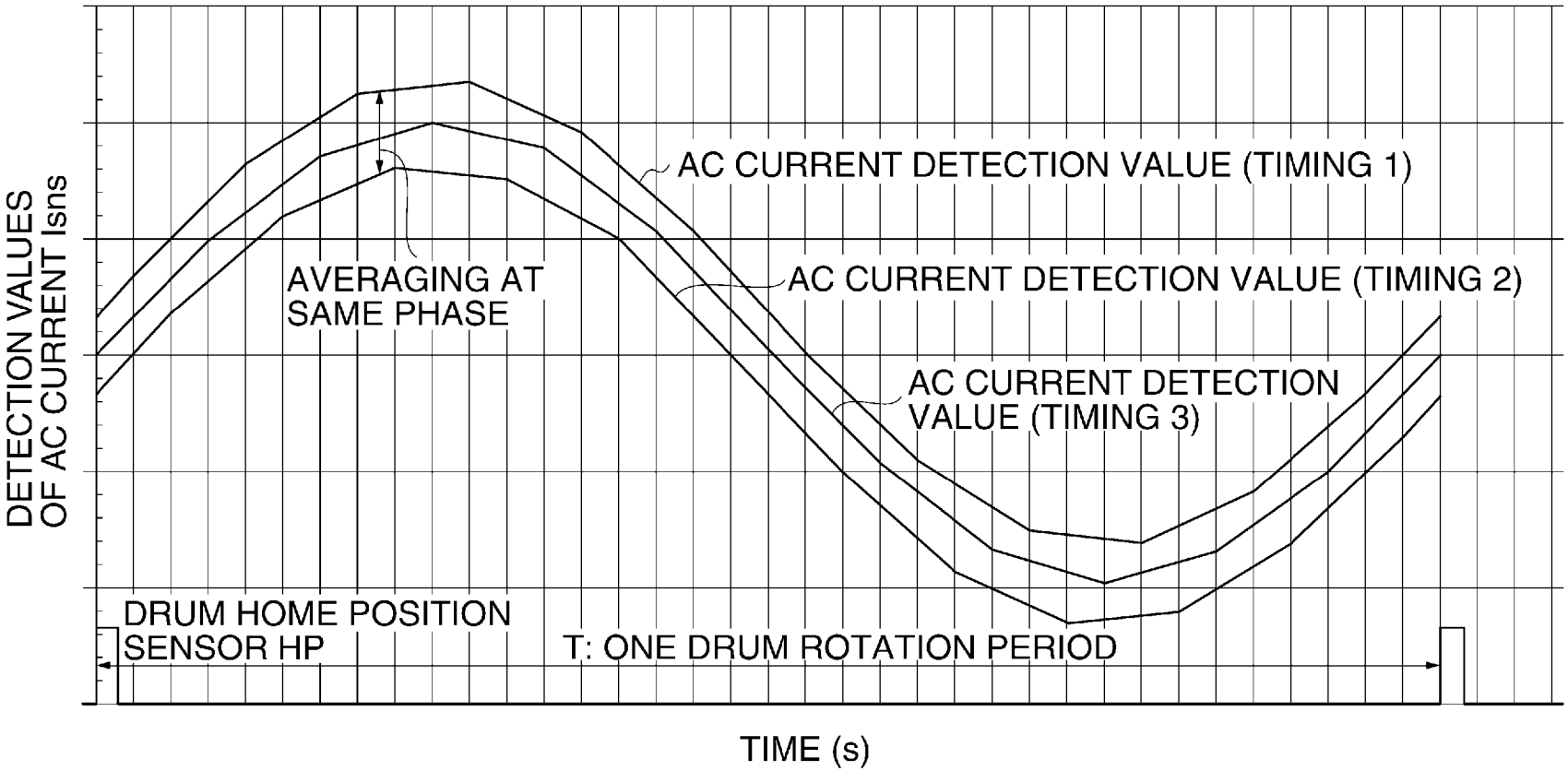
FIG. 12 is a diagram collectively showing the variation curves shown in FIGS. 11A to 11C, respectively.

FIG. 12 is a diagram collectively showing the variation curves shown in FIGS. 11A to 11C, respectively.

In the present embodiment, the variation curves shown in FIG. 12 are averaged for each rotation phase of the photosensitive drum 1. By thus averaging the variation curves for the same phase, an average value Isns_avg of the developing bias AC current is calculated which undergoes variation caused by the rotation period of the photosensitive drum 1.

By employing the above-described method, the average value Isns_avg of the developing bias AC current provides a value free of not only frequency variation which is integral multiple times higher in frequency than the frequency variation caused by the rotation period of the photosensitive drum 1, but also other random frequency variations.

Even when the number of times of sampling is increased without changing the sampling timing, peaks of the frequency variation integer multiple times higher in frequency than the frequency variation caused by the rotation period of the photosensitive drum 1 only overlap, which makes it impossible to eliminate the frequency variation integer multiple times higher in frequency.

Although in the present embodiment, three different sampling timings are used, it is to be understood that a larger number of different sampling timings increase the detection accuracy of the variation curve of the developing bias AC current caused by the rotation period T of the photosensitive drum 1.

From the average value Isns_avg of the developing bias AC current thus calculated, a correction table is created for an output control signal that controls the developing DC bias voltage also in synchronism with the output from the drum home position sensor HP. The corrected developing DC bias value Vdc is expressed by the following equation:

$$Vdc = Vdc_ref - \alpha \cdot Isns_avg$$

wherein:

Vdc_ref: developing DC bias voltage calculated in the normal density control

α: predetermined coefficient

Figure 13A:
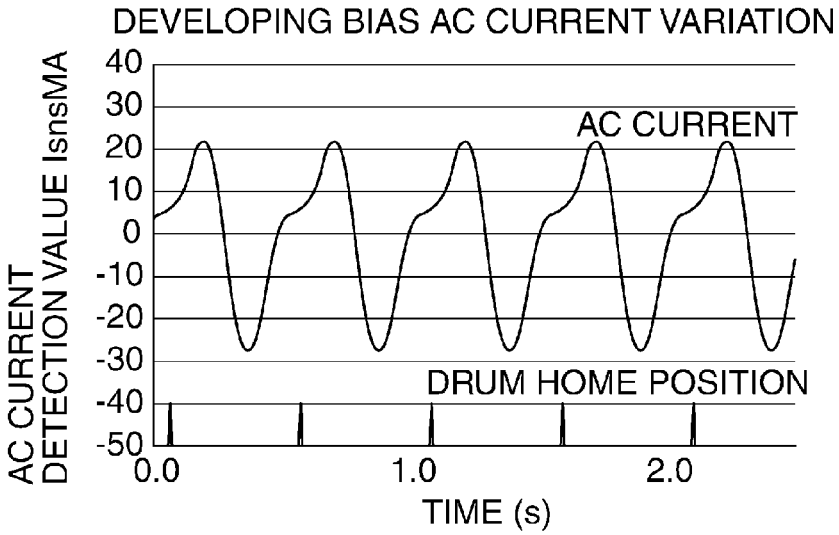
FIG. 13A is a diagram showing an example of a waveform of the developing bias AC current, obtained by moving average.

FIG. 13A is a diagram showing an example of a waveform of the developing bias AC current obtained by moving average.

Figure 13B:
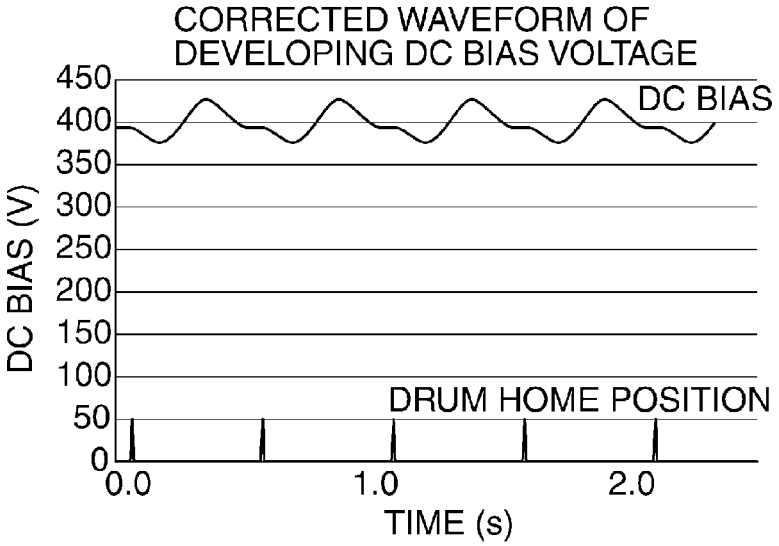
FIG. 13B is a diagram showing a waveform of the developing DC bias voltage obtained by correcting the waveform of the developing bias AC current shown in FIG. 13A.

FIG. 13B is a diagram showing a waveform of the developing DC bias voltage obtained by correcting the waveform of the developing bias AC current shown in FIG. 13A.

Figure 13C:
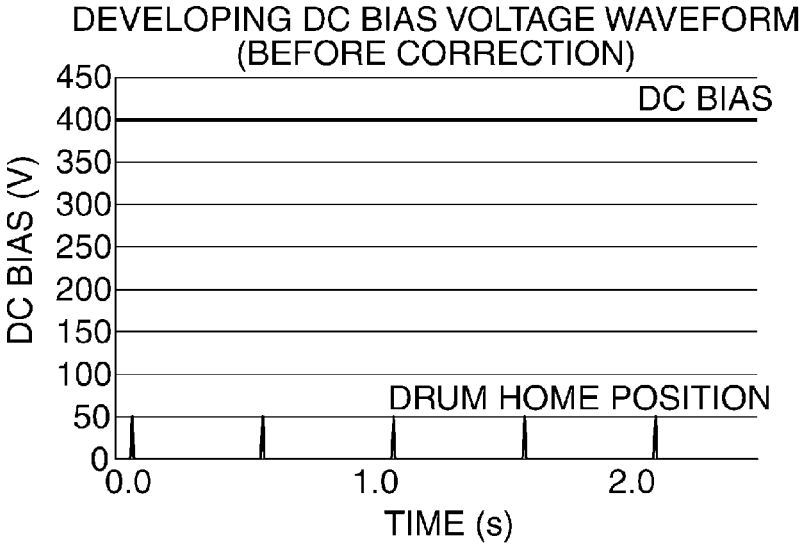
FIG. 13C is a diagram showing a waveform of the developing DC bias voltage before correction.

FIG. 13C is a diagram showing a waveform of the developing DC bias voltage Vdc_ref before correction. Note that in the present embodiment, developing DC bias voltage Vdc_ref is set to 400V by way of example.

As shown in FIGS. 13A and 13B, the developing DC bias voltage is corrected in synchronism with the drum rotation phase such that variation thereof becomes opposite in phase to variation of the developing bias AC current before correction.

Figure 14:
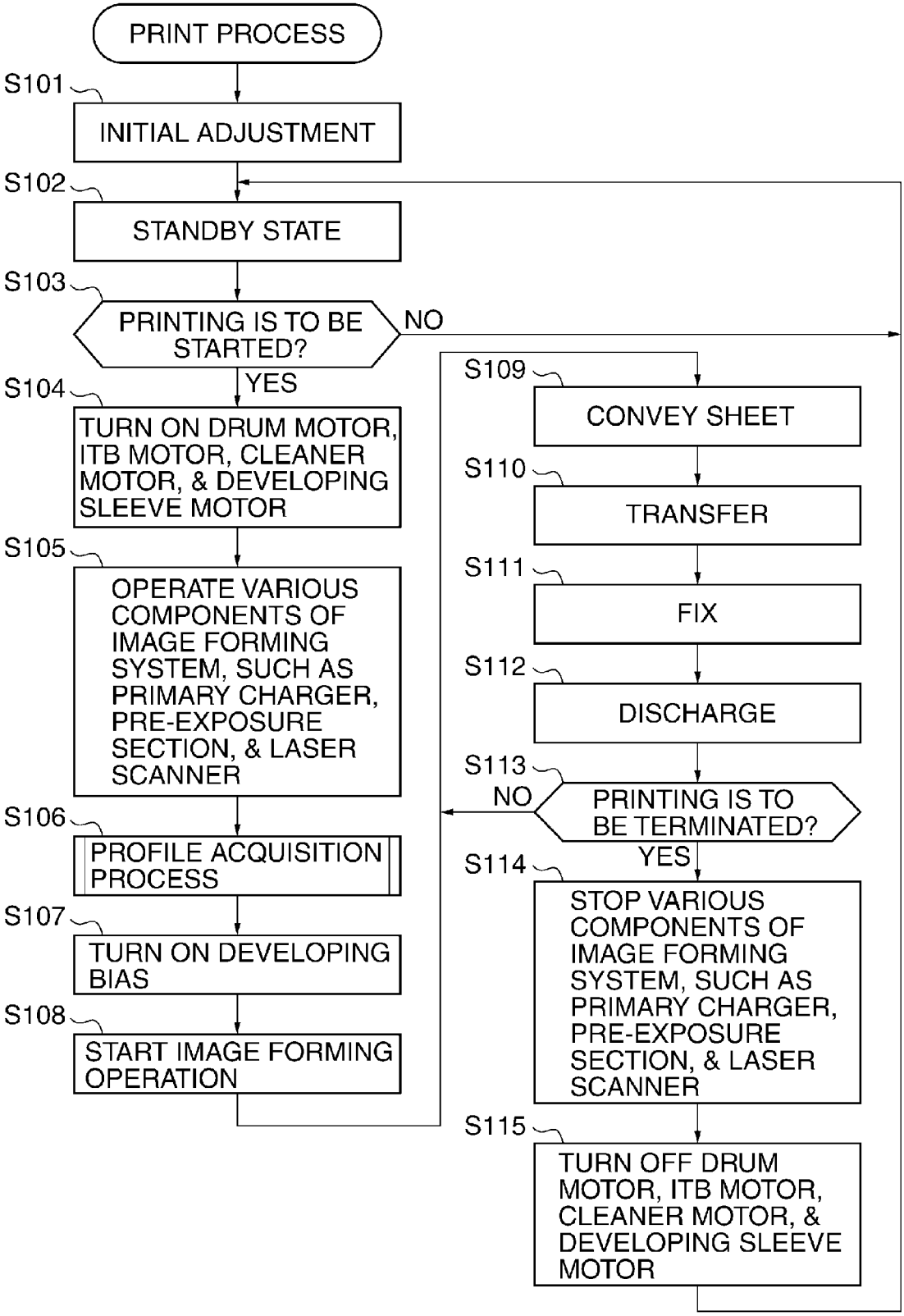
FIG. 14 is a flowchart of a print process executed by a CPU appearing in FIG. 3.

FIG. 14 is a flowchart of a print process executed by the CPU 208 appearing in FIG. 3.

Referring to FIG. 14, when the power is turned on, initial adjustment of the drive sections and the components of the image forming system is executed (step S101), and the image forming apparatus enters a standby state (step S102).

When printing is to be started (YES to a step S103), the drum motor M1, the ITB motor M8, the cleaner motor M5, and the developing sleeve motor M3 are turned on (step S104).

Then, the photosensitive drum 1, the intermediate transfer belt 8, the cleaner 5, and the developing sleeve 3*a* are driven for rotation, and the various components of the image forming system, such as the primary electrostatic charger 2, the pre-exposure section 6, and the laser scanner 7, are operated (step S105), and execute a profile acquisition process for acquiring a profile of SD gap variation, described hereinafter (step S106). In this profile acquisition process, the correction table for the developing DC bias voltage is acquired.

Then, the developing bias is turned on (step S107) to apply the developing bias between the developing sleeve 3*a* and the photosensitive drum 1. At this time, a DC component of the developing bias is output in synchronism with a detection signal from the drum home position sensor HP, according to the correction table for the developing DC bias voltage.

Then, the image forming operation is started (step S108), a sheet is conveyed in synchronism with the image forming operation (step S109), and a toner image is transferred onto the sheet at the transfer section (step S110). Then, the toner image is fixed on the sheet by the fixing section 13 (step S111), and the sheet is discharged out of the apparatus (step S112). The step S108 corresponds to the operation of an image forming unit configured to form an image using a developing bias voltage corrected using the created correction table.

Then, the CPU 208 determines whether or not printing is to be terminated (step S113). If it is determined in the step S113 that printing is not to be terminated (NO to the step S113), the CPU 208 returns to the step S109.

On the other hand, if it is determined in the step S113 that printing is to be terminated (YES to the step S113), the various components of the image forming system, such as the primary electrostatic charger 2, the pre-exposure section 6, and the laser scanner 7, are stopped (step S114).

Then, the drum motor M1, the ITB motor M8, the cleaner motor M5, and the developing sleeve motor M3 are turned off (step S115), and the image forming apparatus 300 returns to the standby state in the step S102.

Figure 15:
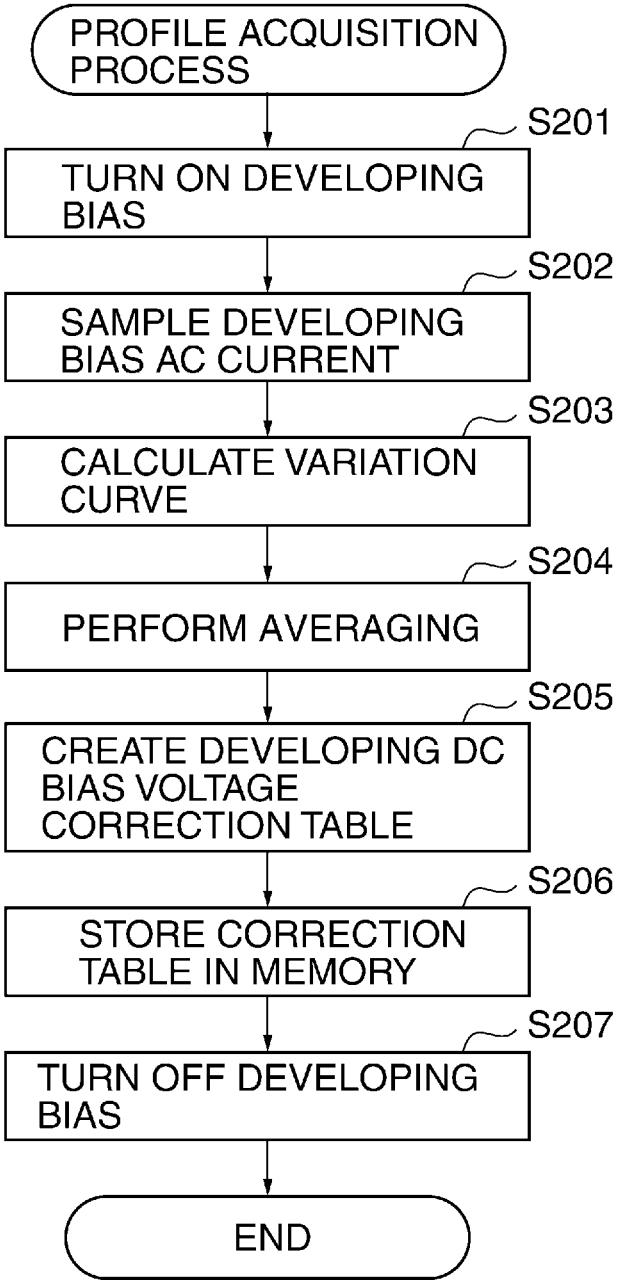
FIG. 15 is a flowchart of a profile acquisition process executed in a step in FIG. 14.

FIG. 15 is a flowchart of the profile acquisition process executed in the step S106 in FIG. 14.

Referring to FIG. 15, first, the developing bias is turned on (step S201). Then, the developing bias AC current is sampled by the CPU 208 in synchronism with an output from the drum home position sensor HP using the AC current detection circuit 204 and the A/D conversion circuit 206, appearing in FIG. 3, and stored in the memory (storage section) of the CPU 208 (step S202). The step 202 corresponds to the operation of a storage unit configured to perform operation for sampling a current value detected by the current value detection unit at a fixed time interval, in synchronism with a rotation phase detected by the phase detection unit, a plurality of times while changing detection start timing, and store the current value sampled each of the plurality of times, into the storage section.

Then, sampling data acquired each time is interpolated by linear segments to thereby calculate a variation curve of the developing bias AC current (step S203), and the variation curve of each sampling is made synchronous with reference to the time of detection of the drum home position sensor HP. The step S203 corresponds to the operation of an interpolated current value calculation unit configured to interpolate current values sampled by the storage unit at each of the plurality of times of sampling to thereby calculate interpolated current values over one rotation of the photosensitive drum, for each time.

Averaging processing is performed on the variation curves of the developing bias AC current for a plurality of rotations for each of predetermined phases from the time of detection of the drum home position sensor HP such that current values at the same phase are averaged (step S204). This step S204 corresponds to the operation of an average value calculation unit configured to calculate an average value of interpolated current values, at the same phase, calculated by the interpolated current value calculation unit over one rotation for each time.

From the averaged current values of the variation curves of the developing bias AC current over the plurality of rotations, a correction table for the output control signal of the developing DC bias is created (step S205). The equation for calculating the corrected DC bias is as described hereinabove. The step S205 corresponds to the operation of a creation unit configured to create a correction table for correcting the developing bias voltage to be applied by the application unit, using the average values calculated by the average value calculation unit.

The correction table for correcting the developing DC bias voltage created as above is stored in the memory of the CPU 208 (step S206), and the developing bias is turned off (step S207), followed by terminating the present process.

In the sampling of the developing bias AC current in the step S202, the developing bias AC current is sampled for a plurality of rotations while changing the sampling points with reference to the time of detection of the drum home position sensor HP for each rotation of the photosensitive drum 1.

It is desirable that the repetition period of sampling is shorter than a period corresponding to the frequency of frequency variation desired to be removed, and in the present embodiment, it is set to T/12 which is 1/12 of the rotation period T of the photosensitive drum 1, by way of example.

Note that the created correction table may be stored in the memory of the CPU 208, a RAM or ASIC (application specific integrated circuit), which is a peripheral circuit of the CPU, or a register in a FPGA (field-programmable gate array).

Figure 16A:
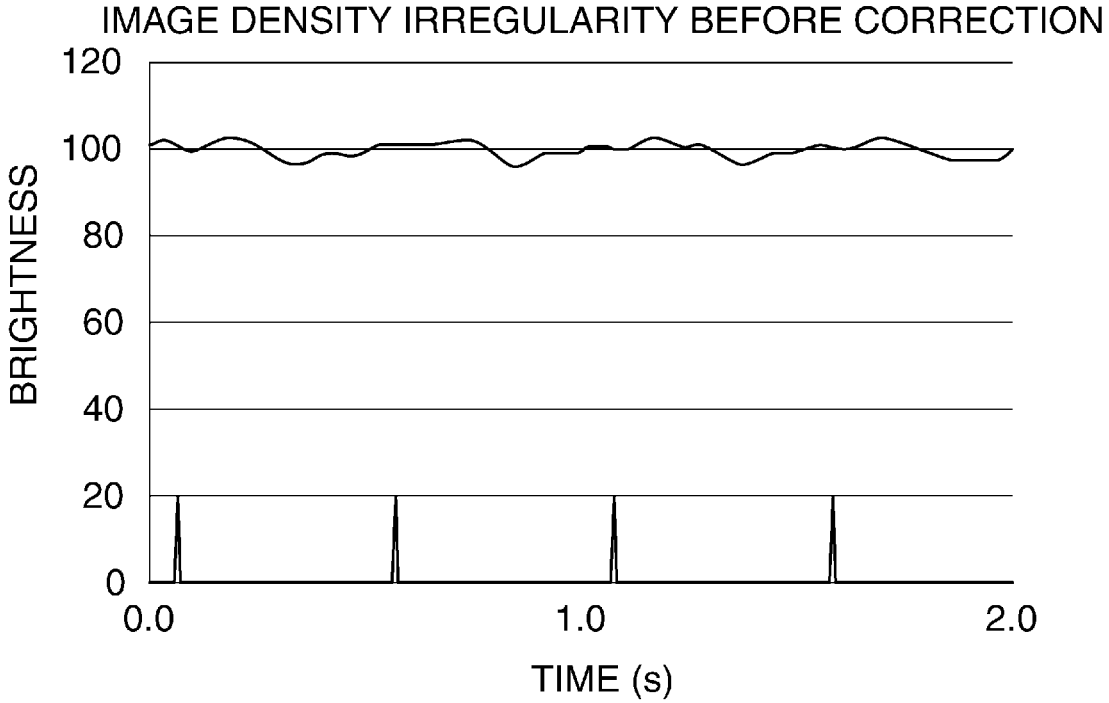
Figure 16B:
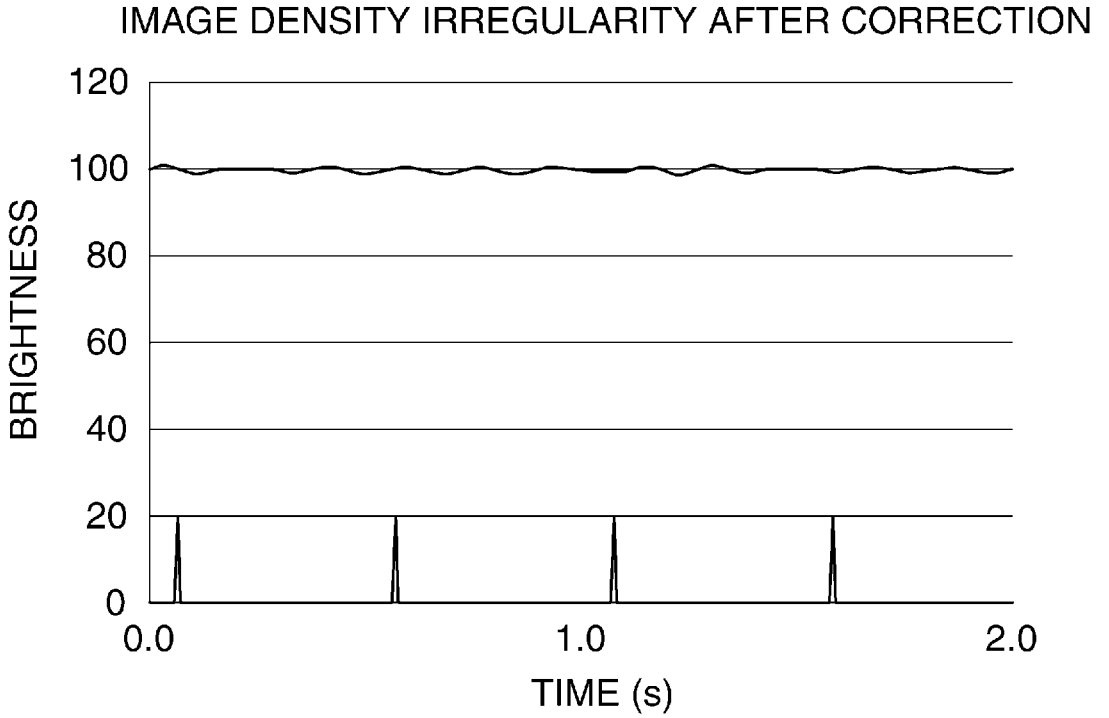

FIGS. 16A and 16B are diagrams formed by plotting values obtained by measuring brightness of an output image of entire-surface halftone having 10% of density in the sub scanning direction in synchronism with an output from the drum home position sensor HP, which show irregularity of image density. In FIGS. 16A and 16B, the horizontal axis represents time, and the vertical axis represents the brightness.

FIG. 16A shows density irregularity in a conventional state in which no correction is made, whereas FIG. 16B shows density irregularity in a state in which correction described in the present embodiment has been made.

As shown in FIG. 16B, compared with the conventional example, image density irregularity is corrected. As shown in this example, the detection start timing of the developing bias AC current is changed for each rotation of the photosensitive drum 1, and detection values of the developing bias AC current are averaged after being made synchronous with the drum rotation reference.

Then, by acquiring a profile of the SD gap variation, and the developing DC bias voltage is corrected in synchronism with the drum rotation phase such that the correction is made in opposite phase to the variation of the developing bias AC current, and the corrected developing DC bias voltage is output, whereby it is possible to reduce density irregularity caused by SD gap variation due to off-centering of the photosensitive drum 1.

Although in the present embodiment, the S-D SD gap variation profile is acquired to create the correction table, at the start of printing, the timing of acquisition of the profile is not limited to this, but the profile may be acquired when power is supplied, after the door of the apparatus is opened or closed, between executions of printing processing, or after a predetermined number of sheets are printed.

Thus, in the present embodiment, by changing the detection timing of an AC component of the developing bias voltage, frequency variations integer multiple times higher in frequency than a frequency of variation in the rotation period of the photosensitive drum 1, which are other factors of variation of the developing bias AC current than the rotation period of the photosensitive drum 1, are cancelled out to thereby extract only variation in the rotation period of the photosensitive drum 1. A correction value dependent on the amount of extracted variation is fed back to the developing bias, whereby it is made possible to suppress density irregularity caused by the SD gap variation.

As described heretofore, according to the present embodiment, current values of the AC component of the developing bias voltage are detected while changing the acquisition timing for each rotation of the photosensitive drum, and detected current values are interpolated and averaged at each same phase, to thereby cancel out factors other than the rotation period of the photosensitive drum to extract only variation in the rotation period of the photosensitive drum.

As a consequence, it is possible to feed back a correction value dependent on the extracted amount of change to the developing bias, and hence it is possible to provide an image forming apparatus that reduces density irregularity which occurs due to variation in the SD gap.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-080387 filed Apr. 8, 2013, which is hereby incorporated by reference herein in its entirety.

What is claimed is:

1. An image forming apparatus comprising:

a photosensitive drum configured to be driven for rotation;

a developing roller configured to carry toner for developing an electrostatic latent image formed on said photosensitive drum, said developing roller being disposed in a manner opposed to said photosensitive drum and driven for rotation; and a memory and a processor, wherein the memory and processor are configured to:

apply a developing bias voltage for forming a developing electric field between said photosensitive drum and said developing roller, to said developing roller, formation of the developing electric field causing the electrostatic latent image to be developed with toner carried by said developing roller;

detect a current value corresponding to an electrostatic capacitance between said photosensitive drum and said developing roller;

detect a rotation phase of said photosensitive drum;

perform operation for sampling a current value detected by said current value detection unit at a fixed time interval, in synchronism with a detected rotation phase, a plurality of times while changing detection start timing, and store a current value sampled each of the plurality of times, into a storage section;

interpolate current sampled values at each of the plurality of times of sampling to thereby calculate interpolated current values over one rotation of said photosensitive drum, for each time;

calculate an average value of interpolated current values at each same phase of the calculated interpolated current values over one rotation of said photosensitive drum, for each time;

create a correction table for correcting the developing bias voltage to be applied, using the calculated average value; and control the developing bias voltage based on the created correction table.

2. The image forming apparatus according to claim 1, wherein a current value of an AC component of current caused to flow by the applied developing bias voltage is detected.

3. The image forming apparatus according to claim 1, wherein the developing bias voltage formed by superimposing an AC voltage and a DC voltage is applied, and wherein the correction table is a table for controlling the DC voltage.

* * * * *